US011071402B2

(12) United States Patent
Yau

(10) Patent No.: US 11,071,402 B2
(45) Date of Patent: Jul. 27, 2021

(54) HANGER WITH HEADWEAR CLIPS

(71) Applicant: Wai Shing Plastic Products Ltd., Kowloon (HK)

(72) Inventor: Wai Keung Yau, Kowloon (HK)

(73) Assignee: WAI SHING PLASTIC PRODUCTS LTD., Hong Kong (HK)

( * ) Notice: Subject to any disclaimer, the term of this patent is extended or adjusted under 35 U.S.C. 154(b) by 6 days.

(21) Appl. No.: 16/364,392

(22) Filed: Mar. 26, 2019

(65) Prior Publication Data

US 2020/0305626 A1 Oct. 1, 2020

(51) Int. Cl.

| | |
|---|---|
| ***A47G 25/48*** | (2006.01) |
| ***A47G 25/10*** | (2006.01) |
| ***A47G 25/30*** | (2006.01) |
| ***A47G 25/34*** | (2006.01) |
| ***A47G 25/14*** | (2006.01) |

(52) U.S. Cl.

CPC ..... *A47G 25/482* (2013.01); *A47G 25/10* (2013.01); *A47G 25/1428* (2013.01); *A47G 25/30* (2013.01); *A47G 25/34* (2013.01); *A47G 25/48* (2013.01)

(58) Field of Classification Search

CPC ..... A47G 25/10; A47G 25/14–92; A47G 25/1407–1492; A47G 25/403–628

USPC ..... D6/315–328

See application file for complete search history.

(56) References Cited

U.S. PATENT DOCUMENTS

| | | | | | |
|---|---|---|---|---|---|
| 1,462,067 | A | * | 7/1923 | Mckenna | A47G 25/16 223/88 |
| 1,990,128 | A | * | 2/1935 | Lederer | A47G 25/486 223/93 |
| 2,656,077 | A | * | 10/1953 | Gensky | A47G 25/487 223/91 |
| 2,804,245 | A | * | 8/1957 | Biondolillo | A47G 25/16 223/90 |
| 2,958,447 | A | * | 11/1960 | Rouseau | A47G 25/70 223/69 |
| 3,502,251 | A | * | 3/1970 | Hart | A47G 25/48 223/96 |
| 3,692,269 | A | * | 9/1972 | Hales | A47F 5/0006 248/691 |
| 4,346,825 | A | * | 8/1982 | Leger | A47G 25/28 211/113 |
| D297,484 | S | * | 9/1988 | Fan | A47G 25/487 D6/315 |
| 5,029,739 | A | * | 7/1991 | Blanchard | A47G 25/16 223/85 |

(Continued)

*Primary Examiner* — Ismael Izaguirre

(74) *Attorney, Agent, or Firm* — Baker & McKenzie LLP

(57) ABSTRACT

Embodiments described herein may be directed towards a hanger including a hook configured to hang the hanger, a top clip disposed at a bottom portion of the hook, a frame extending outward from the bottom portion of the hook, and a first support connected to a bottom portion of the frame via a first support connecting portion. The top clip may include a top clip outer member and a top clip inner member. The frame may include a first side clip and a second side clip. The first side clip may include a first side clip outer member and a first side clip inner member. The second side clip may include a second side clip outer member and a second side clip inner member. The first support may have a substantially horizontally elongated shape.

10 Claims, 12 Drawing Sheets

(56) References Cited

U.S. PATENT DOCUMENTS

| | | | | |
|---|---|---|---|---|
| 6,688,503 | B2 * | 2/2004 | Viazanko | A47G 25/442 223/89 |
| 6,865,832 | B1 * | 3/2005 | Goldman | A47G 25/1435 223/85 |
| D506,077 | S * | 6/2005 | Pluchino | D6/326 |
| D607,218 | S * | 1/2010 | Warren | D6/319 |
| 2009/0078726 | A1 * | 3/2009 | Boulet | A47G 25/325 223/85 |

* cited by examiner

HANGER WITH HEADWEAR CLIPS

TECHNICAL FIELD

Embodiments disclosed herein relate to the functional role, design, and method of use of a hanger with headwear clips.

BACKGROUND

Hangers may be used to hang and/or suspend apparel items above the floor. Hangers may support shirts, coats, or pants. Hangers may comprise a flattened triangular shape, and may or may not be padded. Hangers themselves may be hung from a bar or rod of a closet or clothes rack. A hanger may be slid along a bar or rod from which the hanger is hung. Hangers may be used in lieu of folding clothes. Hangers may be constructed of wire.

SUMMARY

In some embodiments, a hanger may comprise a hook configured to hang the hanger; a top clip disposed at a bottom portion of the hook, the top clip comprising a top clip outer member and a top clip inner member; a frame extending outward from the bottom portion of the hook, the frame comprising a first side clip and a second side clip, wherein the first side clip comprises a first side clip outer member and a first side clip inner member, and wherein the second side clip comprises a second side clip outer member and a second side clip inner member; and a first support connected to a bottom portion of the frame via a first support connecting portion, the first support comprising a substantially horizontally elongated shape.

In some embodiments of the hanger, the first side clip inner member may be longer than the first side clip outer member.

In some embodiments of the hanger, at least one of the top clip inner member, the first side clip inner member, and the second side clip inner member may comprise a ramped portion.

In some embodiments of the hanger, at least one of the top clip outer member, the first side clip outer member, and the second side clip outer member may comprise a protrusion extending inwardly toward the at least one of the top clip inner member, the first side clip inner member, and the second side clip inner member, respectively.

In some embodiments of the hanger, the first support may comprise a first support tab configured to be inserted into a first support connector comprised in the bottom portion of the frame.

In some embodiments, the hanger may comprise a second support connected to a bottom portion of the top clip outer member, the second support comprising a substantially horizontally elongated shape.

In some embodiments of the hanger, the second support may comprise a second support connector configured to receive a second support tab comprised in the bottom portion of the top clip outer member.

In some embodiments, the hanger may comprise a sizer web receiving portion disposed between the hook and the frame.

In some embodiments of the hanger, the sizer web receiving portion may comprise a catch protrusion.

In some embodiments, the hanger may comprise a removable sizer web connected to the sizer web receiving portion.

In some embodiments, a hanger may comprise a hook configured to hang the hanger; an outer frame extending outward from the bottom portion of the hook, the outer frame comprising a first side clip inner member and a second side clip inner member; an inner frame connected to the outer frame at a first bottom portion and a second bottom portion of the outer frame, the inner frame comprising a first side clip outer member and a second side clip outer member; a first support connecting portion extending downward from a middle bottom portion of the inner frame; and a first support connected to the first support connecting portion, the first support comprising a substantially horizontally elongated shape.

In some embodiments of the hanger, at least one of the top clip inner member, the first side clip inner member, and the second side clip inner member may comprise a ramped portion.

In some embodiments of the hanger, the first support may comrpise a first support connector configured to receive a first support tab comprised in the middle bottom portion of the inner frame.

Some embodiments of the hanger may comprise a second support connected to a bottom portion of the top clip outer member.

In some embodiments of the hanger, the second support may comprise a second support tab configured to be inserted into a second support connector comprised in the bottom portion of the top clip outer member.

Some embodiments of the hanger may comprise a sizer web receiving portion disposed between the hook and the frame.

In some embodiments of the hanger, the sizer web receiving portion may comprise a catch protrusion.

In some embodiments of the hanger, the sizer web receiving portion may comprise at least one guiding portion.

In some embodiments, a sizer web may be connected to the sizer web receiving portion.

In some embodiments of the hanger, the sizer web may comprise two first protrusions and two second protrusions, wherein the two first protrusions and the two second protrusions form a first cavity, and wherein the catch protrusion is disposed within the first cavity.

BRIEF DESCRIPTION OF THE DRAWINGS

Reference is now made to the following descriptions taken in conjunction with the accompanying drawings.

DETAILED DESCRIPTION

Various aspects of the components of a hanger design and the underlying elements of the disclosed embodiments involved in the mechanism, utility, and function of the hanger, as outlined in the present disclosure, are described. It should be noted that the following explanations are merely exemplary in describing the inventions and methods of the present disclosure. Accordingly, several modifications, changes and substitutions are anticipated, and the following detailed description is not intended to limit the scope of the disclosure, as claimed. Further, while the descriptions that follow are meant to provide a detailed understanding of the disclosed embodiments of the hanger design, some embodiments may use part or all of the details herein described. It should be noted that the figures that follow depict drawings of a hanger and its design that are not to precise scale. Moreover, directional terms such as top, bottom, left, right, inside, outside, distal and proximal may be used with respect to the referenced figures in the text that follows, not to be related to anything beyond the referenced figures. Said differently, directional terms are not to be construed as limiting in scope of the disclosed inventions as they are merely descriptive of the figures that are referenced. For example, a side may refer to at least one of a top side, a bottom side, a left side, a right side, a front side, a rear side, a surface, an edge, and/or the like. Finally, descriptive words such as clips, catches, supports, and connectors, in the plural or singular, may be used interchangeably to describe various aspects of the invention depending on the embodiment of the hanger and its underlying components.

Figure 1A:
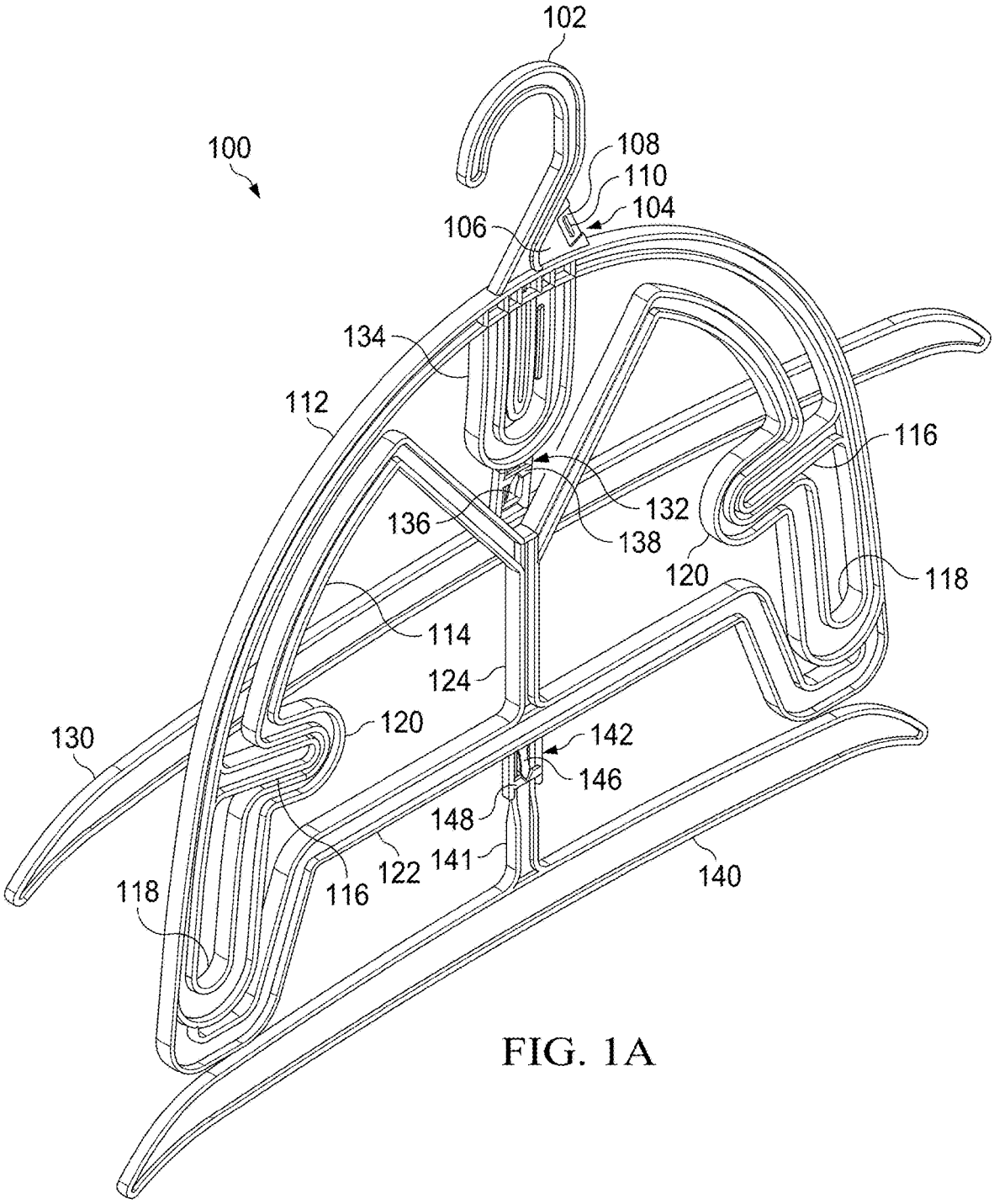
FIG. 1A illustrates a perspective view of a hanger, in accordance with some embodiments of the disclosure.

FIG. 1A illustrates an example embodiment of a hanger 100 from a perspective view. The hanger 100 may comprise a hook 102, sizer clip receiver 104 (which may in turn comprise a support portion 106, recessed portion 108, and/or catch protrusion 110), outer frame 112, inner frame 114, side clip inner member 116, frame connecting portion 118, side clip outer member 120, lower frame portion 122, inner frame support 124, second support 130, second support connector 132, top clip outer member 134, second support tab 136, second support tab catch 138, first support 140, first support connecting portion 141, first support connector 142, first support tab 146, and/or first support tab catch 148. As illustrated in FIG. 1A, any and/or all portions of a hanger may comprise ridged surfaces, surfaces bounded by raised portions, and/or depressed interior regions, which may be for manufacturing, handling, structural, material minimization, and/or aesthetic purposes.

A hook 102 may be used to hang the hanger 100 from a rod, bar, clothesline, knob, hook, and/or any other support operable to suspend the hanger 100. A hook 102 may comprise a shape that is at least partially complementary to the structure upon which the hanger 100 is hung. For example, a hook 102 may comprise a substantially circular interior if the hanger 100 is intended to hung from a cylindrical bar (e.g. within a closet and/or comprised within a clothing rack). A hook 102 may be attached, connected to, and/or integrally formed with the frame (e.g. outer frame 112) of a hanger 100 and/or a sizer clip receiver 104 region of a hanger 100. A hook 102 may be able to swivel and/or rotate relative to an outer frame 112 of a hanger 100 (e.g. via a screw attachment and/or nail and washer connector between the hook 102 and outer frame 112).

A sizer clip receiver 104, which may be positioned above an outer frame 112 and adjacent to a hook 102 of the hanger 100, may be configured to receive and/or mate with a sizer clip. A sizer clip (not shown in FIG. 1A) may be used to indicate the size of the garment to be hung from the hanger 100 and/or to indicate the size of the hanger 100, e.g. based on the color and/or textual markings on the sizer clip. The connection mechanism between the sizer clip receiver 104 and the sizer clip may allow for multiple attachments and removals of the sizer clip, e.g., in order to replace the sizer clip with an appropriately-labeled size that matches the garment to be hung from the hanger 100. The sizer clip receiver 104 may comprise a sizer clip support portion 106, a recessed portion 108, and/or a catch protrusion 110. The sizer clip receiver 104 design may be such that a sizer clip may be slid onto the recessed portion 108 and over the catch protrusion 110. The catch protrusion 110 may hold the sizer clip in place, e.g. if the sizer clip is comprised of at least a partially flexible and/or resilient material such that the sizer clip can be slightly bent and/or expanded over the catch protrusion 110 and return to an unbent and/or unexpanded form after positioning over the catch protrusion 110.

The frame of the hanger 100 may comprise an outer frame 112, an inner frame 114, and/or a lower frame portion 122. An outer frame 112 may comprise a flattened triangular shape, a semi-circular shape (e.g., similar to what is illustrated in FIG. 1A), a shape corresponding to headwear to be clipped to and/or hung from the hanger 100, a shape corresponding to human shoulders, a shape corresponding to flattened headwear, and/or any shape complementary to the shape of apparel to be hung from the hanger 100. An outer frame 112 may comprise notches (not illustrated in FIG. 1A), e.g., for hanging apparel with straps. An inner frame 114 may comprise a shape complementary to the outer frame 112 along at least a partial region of the outer frame 112. The inner frame 114 may be connected to the outer frame 112 via one or more frame connections portions 118. For example, the one or more frame connecting portions 118 may be located at the bottom of the hanger 100 frame, and may be integrally formed with the outer frame 112 and the inner frame 114 of the hanger 100 (e.g. the hanger frame may be comprised of a single piece of injection-molded plastic). The frame connecting portions 118 may comprise a U-shape at the bottom of the outer frame 112 and inner frame 114. The inner frame 114 may be formed to surround and/or provide a space margin to clip portions of the hanger 100 (e.g. the top clip outer member 134 and/or one or more side clip inner members 116). For example, the inner frame 114 may comprise one or more side clip outer members 120 that are formed complementary to the shape of one or more side clip inner members 116 in order to provide a clip mechanism. Additionally or alternatively, the top of the inner frame 114 may comprise a V-shape (as illustrated in FIG. 1A) near a top portion of the inner frame 114 in order to provide space around a top clip outer member 134, decrease manufacturing costs, facilitate manufacturing, and/or facilitate hanging of a garment and/or garment portion (not shown in FIG. 1A), such as a hat or hood, over the inner frame 114 of the hanger 100. The frame of a hanger 100 may further comprise a lower frame portion 122, which may connect two or more sides of an outer frame 112, inner frame 114, and/or frame connection portions 118. A lower frame portion 122 may structurally support, add rigidity, and/or preserve the shape of the outer frame 112, inner frame 114, and/or frame connection portions. A lower frame portion 122 may additionally or alternatively be connected to and/or integrally formed with a central region of the inner frame 114 via an inner frame support 124. A lower frame portion 122 may extend from the frame connecting portions 118 and/or may extend from the outer frame 112 (e.g., thereby forming a second U-shape at the bottom of the outer frame 112 and inner frame 114) and/or inner frame 114.

A hanger 100 may comprise one or more side clips, which in turn may comprise a side clip inner member 116 and a side clip outer member 120. As illustrated in FIG. 1A, one or more side clip inner members 116 may project from and/or be connected to the interior portion of an outer frame 112. A side clip inner member 116 may comprise an ovular shape, a rectangular shape, a rounded rectangular shape, and/or any shape complementary to the interior portion of a side clip outer member 120 and operable to clip a sheet-like geometry (e.g. a portion of a garment) between the side clip inner member 116 and the side clip outer member 120. For example, the side clip inner member 116 may be bent and/or depressed out of the same plane as the side clip outer member 120, thereby allowing insertion of an item and/or a portion of an item to be inserted between the side clip inner member 116 and the side clip outer member 120 before releasing the pressure required to deflect the side clip inner member 116 or the side clip outer member 120 out of the plane of the side clip outer member 120 or the side clip inner member 116, respectively. At least one of the side clip inner member 116, the side clip outer member 120 and/or the connection points thereof to an outer frame 112 and/or inner frame 114 may be comprised of an at least partially pliable material (e.g. a flexible plastic) in order facilitate use and/or clamping of the one or more side clips. A top clip, which may comprise a top clip outer member 134, may perform a similar function to the one or more side clips, and may comprise similar material and/or structural properties.

The hanger 100 may comprise a first support 140 and/or second support 130. A first support 140 and/or second support 130 may be used to support, suspend, and/or hang one or more items of apparel. For example, a first support 140 may be used to hang a shirt and/or torso portion of a garment while a second support may be used to hang a pair of pants, trousers, and/or another torso portion of a garment. A first support 140 and/or a second support 130 may be used to hold one or more items of apparel in conjunction with one or more side clips and/or a top clip of a hanger. For example, a torso portion of a hoody jacket may be hung on the first support 140, a hood of the hoody jacket may be suspended and/or clipped by at least one of a side clip and/or top clip of the hanger 100, and a corresponding pair of pants may be hung on the second support 130. While any portion of the hanger 100 (e.g. outer frame 112, inner frame 114, lower frame portion, side clips, top clip, first support 140, and/or second support 130) may be used to hang apparel, it is not necessary to use all portions of the hanger 100 to hang garments. For example, it is possible to use the hanger 100 to suspend a beanie cap, e.g. by clipping in the cap with one or more side clips (which may comprise a side clip inner member 116 and/or a side clip outer member 120) and/or a top clip.

A first support 140 and/or second support 130 may be integrally formed with the hanger 100 and/or may be connected to the hanger 100 via a first support connector 142 and/or second support connector 132, respectively. Additionally or alternatively, a first support connecting portion 141 may be used to connect a first support 140 to the first support connector 142. A first support connector 142 and/or second support connector 132 may be attached to the hanger 100 and/or to the respective support 140, 130. For example, as illustrated in FIG. 1A, the first support connector 142 is attached to and/or integrally formed with the bottom of the lower frame portion 122 of the hanger 100. The first support 140 comprises a first support tab 142 disposed at the top end of the first support connecting portion 141 of the first support 140. The first support tab 146 and/or the attachment interface between the first support tab 146 and the first support connecting portion 141 may be at least partially flexible and/or resilient such that the first support tab 146 may be at least partially depressed towards the first support connecting portion 141 during insertion of the first support tab 146 into the first support connector 142. After insertion of the first support tab 146 into the first support connecting portion 141, the first support tab 146 may return to an undepressed state. The first support connector 142 may comprise a first support tab catch 148 configured to provide a counterforce against the first support tab 146, such that the first support tab 146 and/or first support 140 cannot be removed from the first support connector 142 without manually (e.g. via a finger press) depressing the first support tab 146 so that it may slide below the first support tab catch 148. A similar removable connection mechanism may be used in order to connect a second support 130 to a second support tab 136 attached to a hanger 100, and/or the hook 102, outer frame 112, inner frame 114, and/or top clip outer member thereof. For example, as illustrated in FIG. 1A, the second support 130 may comprise a second support connector 132 disposed on the top middle of the second support 130. The second support connector 132 may comprise a second support tab catch 138, which may serve a similar purpose as the first support tab catch 148 (e.g. the second support tab catch may be used to secure the second support tab 136 from removal after insertion of the second support tab 136 into the second support connector 132.

Figure 1B:
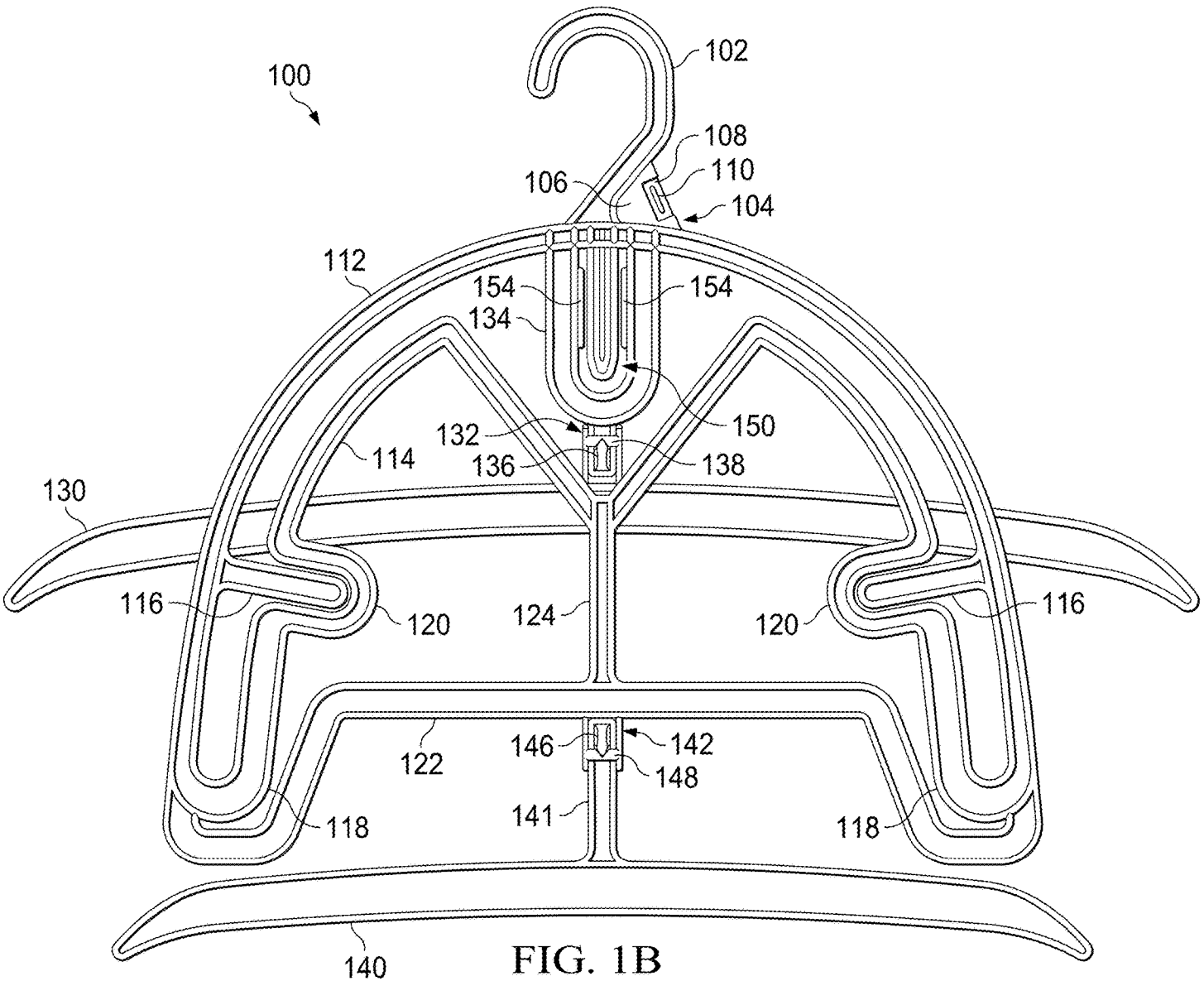
FIG. 1B illustrates a front view of a hanger, in accordance with some embodiments of the disclosure.

FIG. 1B illustrates an example embodiment of a hanger 100 from a front view. The hanger 100 may comprise a hook 102, sizer clip receiver 104 (which may in turn comprise a support portion 106, recessed portion 108, and/or catch protrusion 110), outer frame 112, inner frame 114, side clip inner member 116, frame connecting portion 118, side clip outer member 120, lower frame portion 122, inner frame support 124, second support 130, second support connector 132, top clip outer member 134, second support tab 136, second support tab catch 138, first support 140, first support connecting portion 141, first support connector 142, first support tab 146, first support tab catch 148, top clip inner member 150, and/or a top clip protrusion 154.

A top clip may comprise a top clip outer member 134, a top clip inner member 150, and/or one or more top clip protrusions 154. A top clip inner member 150 may have a functional use similar to a side clip inner member 116, e.g. the top clip inner member 150 may be initially bent and/or deflected relative to the top clip outer member 134 in order to allow insertion of a material (e.g. a garment and/or headwear) in order to clip in and/or clamp down on the material to hold it in place. Top clip protrusions 154 may facilitate the clipping and/or clamping of garments by reducing the amount of space between the top clip inner member 150 and the top clip outer member 134. Additionally or alternatively, the top clip protrusions 154 may be artifacts and/or flash resulting from an injection molding process (e.g. in the case that the hanger 100 and/or top clip was manufactured via injection molding).

As illustrated in FIG. 1B, the first support tab 146 and/or second support tab 136 may comprise a triangular tip that mates with a complementary (e.g. triangular) cutout of a first support tab catch 148 and/or second support tab catch 138, respectively.

Figure 1C:
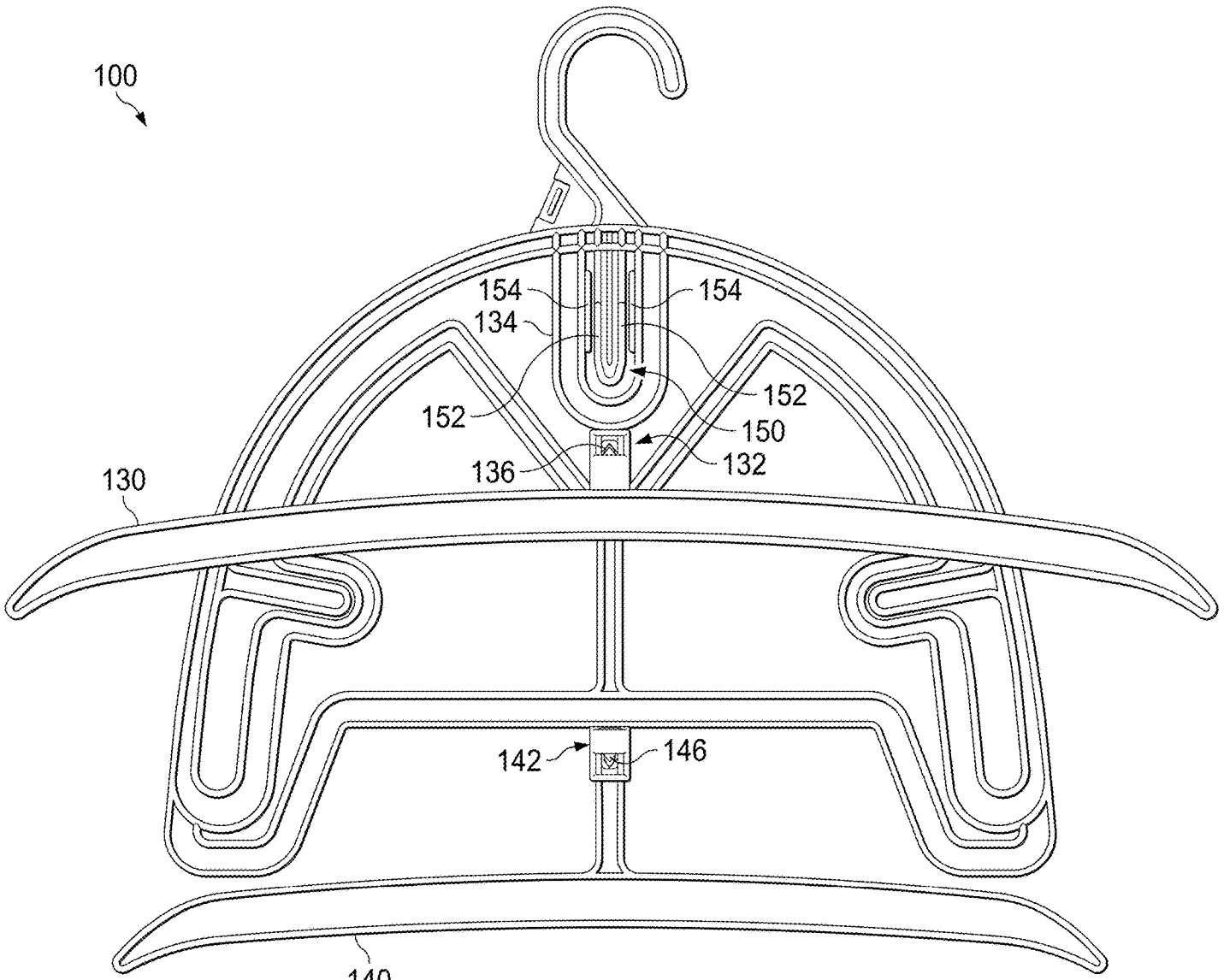
FIG. 1C illustrates a back view of a hanger, in accordance with some embodiments of the disclosure.

FIG. 1C illustrates an example embodiment of a hanger 100 from a back view. The hanger 100 may comprise a second support 130, second support connector 132, top clip outer member 134, second support tab 136, first support 140, first support connector 142, first support tab 146, top clip inner member 150, top clip ramped portion 152, and/or a top clip protrusion 154.

In some embodiments, a second support 130 may be positioned behind the hanger 100 (as illustrated in FIG. 1C) and/or in front of the hanger. As illustrated in FIG. 1C, the first support tab 146 and/or second support tab 136 may be visible from the back of the hanger 100, and/or may protrude beyond the first support connector 142 and/or second support connector 132, respectively. The top clip inner member 150 of a top clip may comprise one or more ramped portions 152 (e.g. one on each lateral side of the top clip inner member 150, as illustrated in FIG. 1C), which may increase (e.g. linearly) in height off of the top clip inner member 150 from the tip of the top clip inner member 150 upward. One or more ramped portions 152 of a top clip inner member 150 may be used to facilitate the clipping and/or clamping of apparel between the top clip inner member 150 and the top clip outer member 134. For example, the one or more ramped portions 152 may essentially increase the thickness along the top clip inner member 150, thereby requiring the top clip inner member 150 to deflect to a greater degree relative to the top clip outer member 134 when a garment is inserted, which may in turn result in a larger compression force between the top clip inner member 150 and the top clip outer member 134 as the material and/or connection mechanism between the two seeks to return the top clip inner member 150 to a substantially same plane as the top clip outer member 134.

Figure 1E:
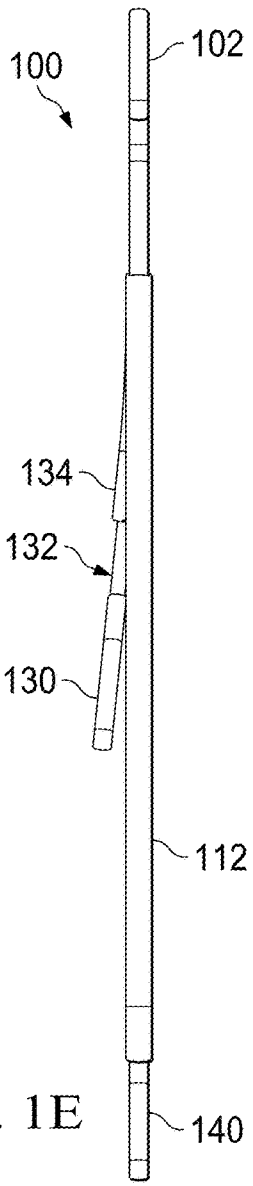
FIG. 1E illustrates a left view of a hanger, in accordance with some embodiments of the disclosure.
Figure 1D:
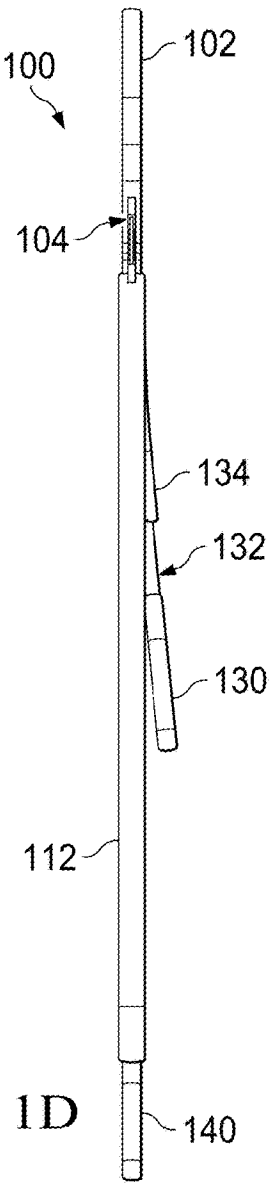
FIG. 1D illustrates a right view of a hanger, in accordance with some embodiments of the disclosure.

FIG. 1D illustrates an example embodiment of a hanger 100 from a left view. The hanger 100 may comprise a hook 102, sizer clip receiver 104, outer frame 112, second support 130, second support connector 132, top clip outer member 134, and/or first support 140.

FIG. 1E illustrates an example embodiment of a hanger 100 from a right view. The hanger 100 may comprise a hook 102, outer frame 112, second support 130, second support connector 132, top clip outer member 134, and/or first support 140.

As illustrated in FIGS. 1D and 1E, a second support 130 may be deflected, positioned, and/or disposed on a front and/or back side of the hanger 100. The second support 130 may be offset from the remainder of the hanger (e.g. the outer frame 112 and/or first support 140) by design necessity (e.g. no physical space to accommodate the second support in the same plane) and/or due to intended usage of the second support 130 (e.g. to hang another garment that needs space to hang away from a garment hung on the first support 140). Also, as illustrated in FIG. 1D, a sizer clip receiver 104 may comprise a width less than that of the hook 102 and/or outer frame 112 of the hanger 100. The relatively smaller width of the sizer clip receiver 104 may be implemented in order to save material costs, to accommodate a sizer clip design, and/or to allow an installed sizer clip to have a resultant width that is substantially similar to the hook 102 and/or outer frame 112, such that the installed sizer clip is flush with its structural surroundings.

Figure 1F:
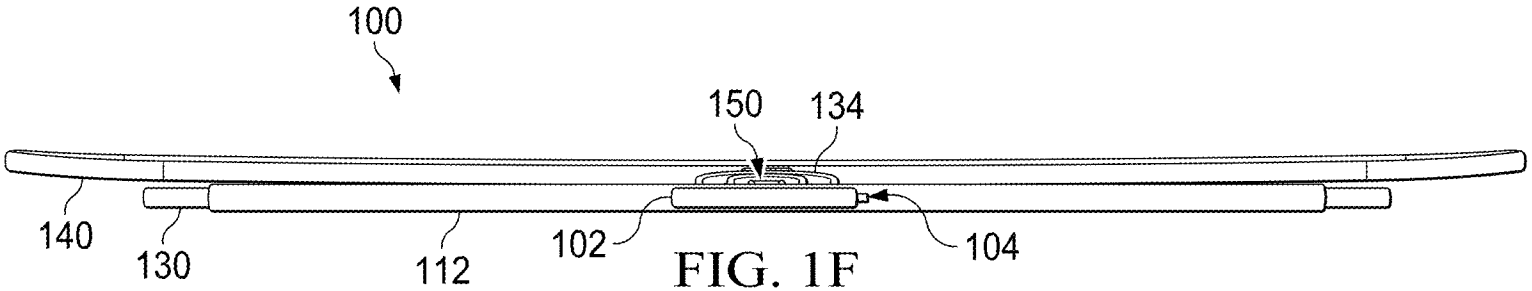
FIG. 1F illustrates a top view of a hanger, in accordance with some embodiments of the disclosure.

FIG. 1F illustrates an example embodiment of a hanger 100 from a top view. The hanger 100 may comprise a hook 102, sizer clip receiver 104, outer frame 112, second support 130, top clip outer member 134, first support 140, and/or top clip inner member 150.

Figure 1G:
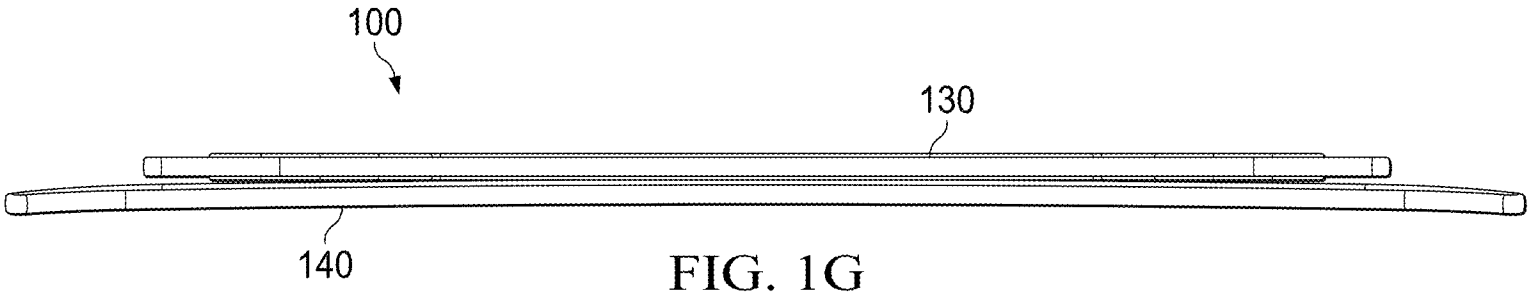
FIG. 1G illustrates a bottom view of a hanger, in accordance with some embodiments of the disclosure.

FIG. 1G illustrates an example embodiment of a hanger 100 from a bottom view. The hanger 100 may comprise a second support 130 and/or first support 140.

Figure 2:
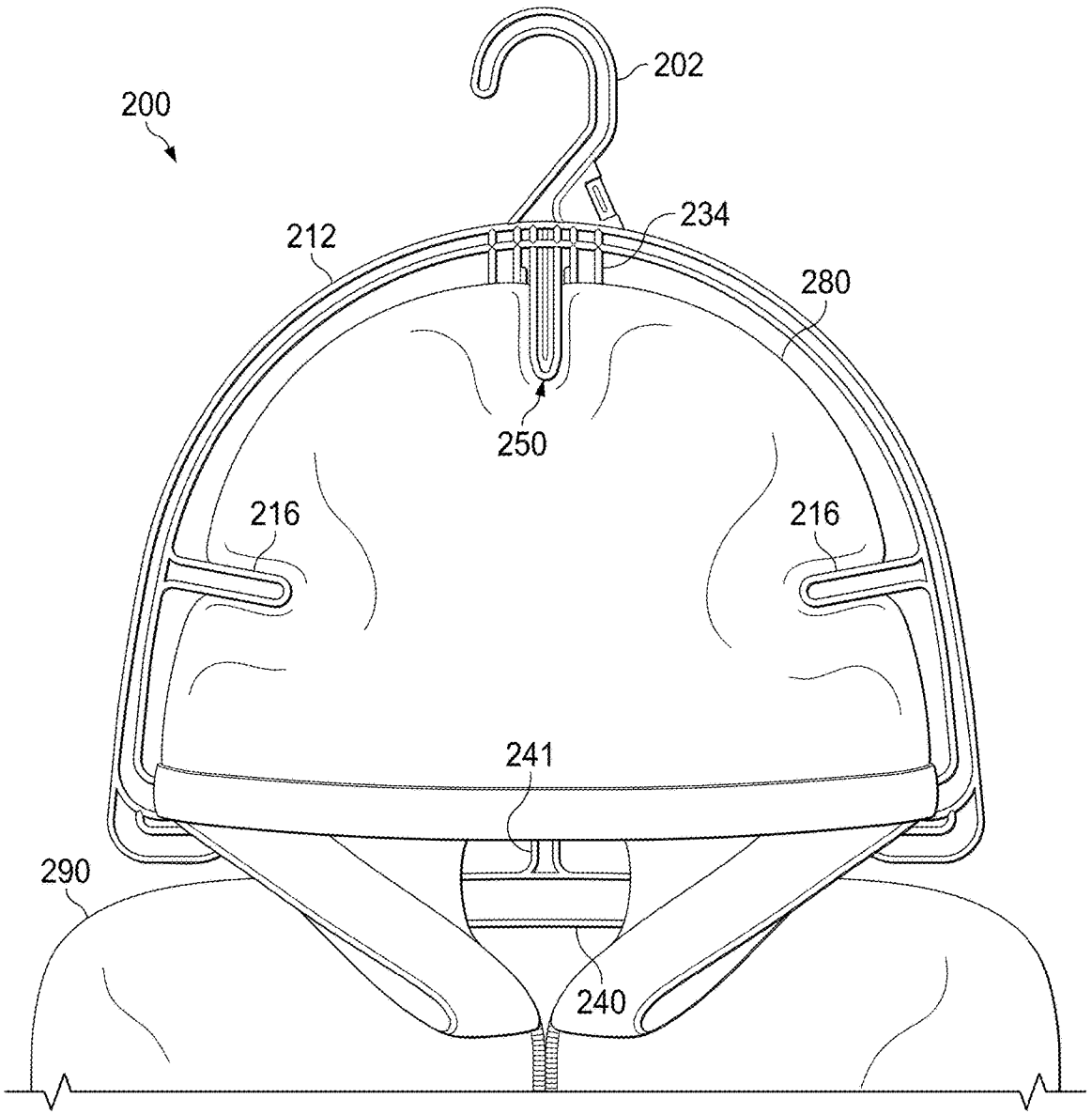
FIG. 2 illustrates a hanger supporting an item of apparel, in accordance with some embodiments of the disclosure.

FIG. 2 illustrates an example embodiment of a hanger 200 supporting an item of apparel, which may comprise a headwear portion 280 and a torso portion 290. The hanger 200 may comprise a hook 202, outer frame 212, side clip inner member 216, top clip outer member 234, first support 240, first support connecting portion 241, and/or a top clip inner member 250.

As illustrated in FIG. 2, a headwear portion 280 of a garment may be clipped into place within a region surrounded by the outer frame 212 via a top clip comprising a top clip inner member 250 and a top clip outer member 234, and/or via one or more side clips comprising at least a side clip inner member 216. The relatively longer length of a side clip inner member 216 relative to a corresponding side clip outer member may allow at least a partial visual occlusion of the side clip outer member after insertion of the headwear garment into the one or more side clips, which may be beneficial (e.g. for aesthetic purposes). A hanger 200 may additionally or alternatively support of a torso portion 290 of a garment via a first support 240, whether or not the torso portion 290 is attached to the headwear portion 280. A hanger supporting a headwear portion 280 and/or torso portion 290 of a garment may be hung via its hook 202, e.g. for visual display and/or handling purposes. A second support (not shown in FIG. 2) may or may not be used to support a garment (e.g. matching legwear) associated or unassociated with the headwear portion 280 and/or torso portion 290. The headwear portion 280 and torso portion 290 need not be physically connected and/or associated with the same outfit. For example, a standalone beanie cap could be clipped by a top clip and/or one or more side clip while an unrelated T-shirt may be supported by the first support 240 (e.g. for efficient storage, efficient space usage, and/or suggestive retailing).

Figure 3:
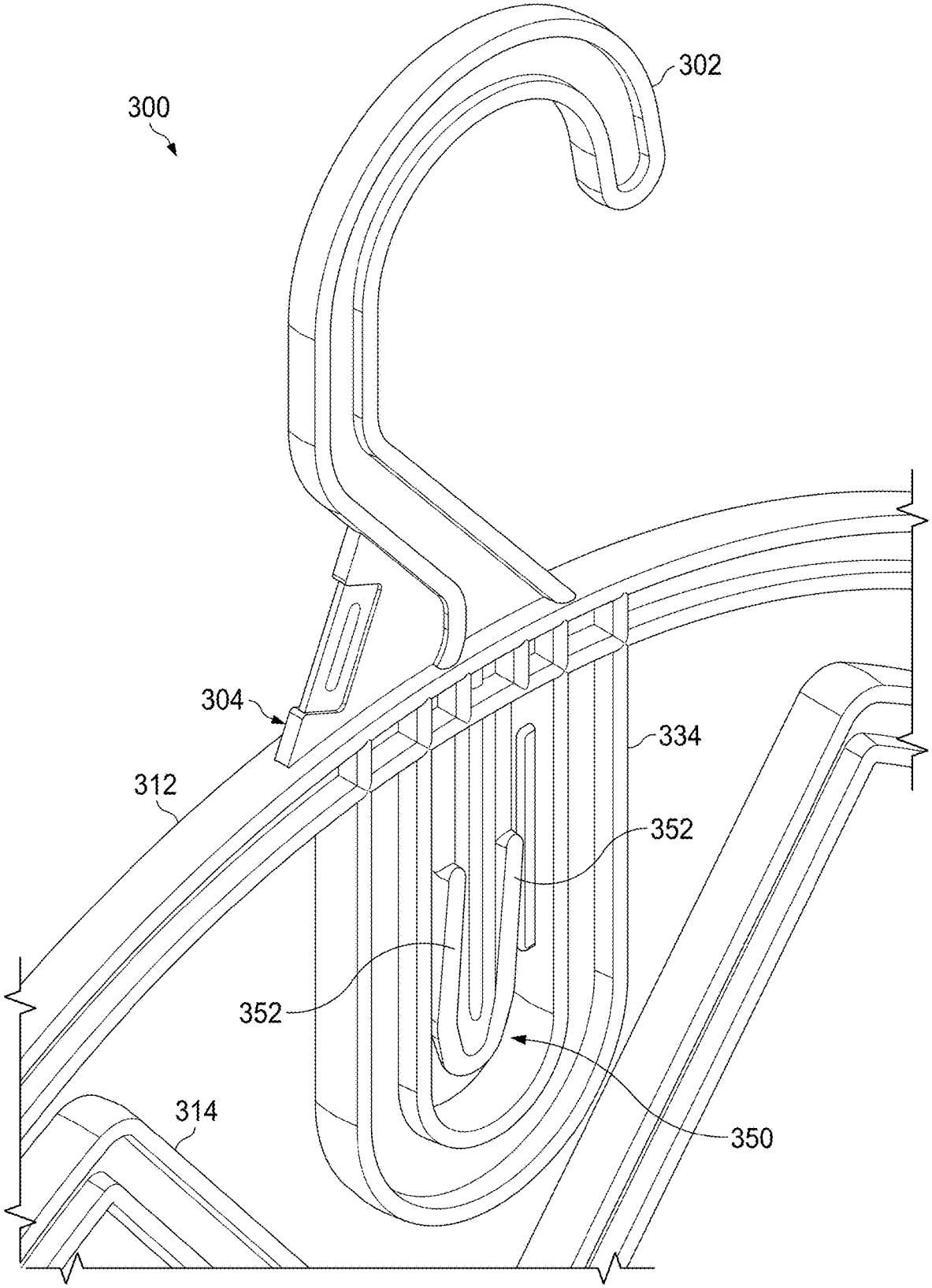
FIG. 3 illustrates a perspective view of a hanger portion, in accordance with some embodiments of the disclosure.

FIG. 3 illustrates a hanger portion 300 from a perspective view. The hanger 300 may comprise a hook 302, sizer clip receiver, outer frame 312, inner frame 314, top clip outer member 334, top clip inner member 350, one or more top clip ramped portions 352, and/or one or more top clip protrusions 354.

As illustrated in FIG. 3, ramped portions 352 of a top clip inner member 350 may increase in height off the top clip inner member 350 from about 0-0.5 cm to about 1.0-3.0 cm. The corners of the one or more ramped portions 352 may be rounded, and the ramped portion may not extend along the entire length of the top clip inner member 350. Beyond potentially providing additional compression force after insertion of a garment, the one or more ramped portions 352 may additionally or alternatively provide a hook and/or catch mechanism to secure an inserted garment based via the end portion (e.g. where the height of the one or more ramped portions 352 quickly drops off after increasing from the tip of the top clip inner member) of the one or more ramped portions 352. For example, the force of gravity pulling downward on an inserted garment may not be able to overcome the friction of fabric caught by an end portion of the one more ramped portions 352.

Figure 4:
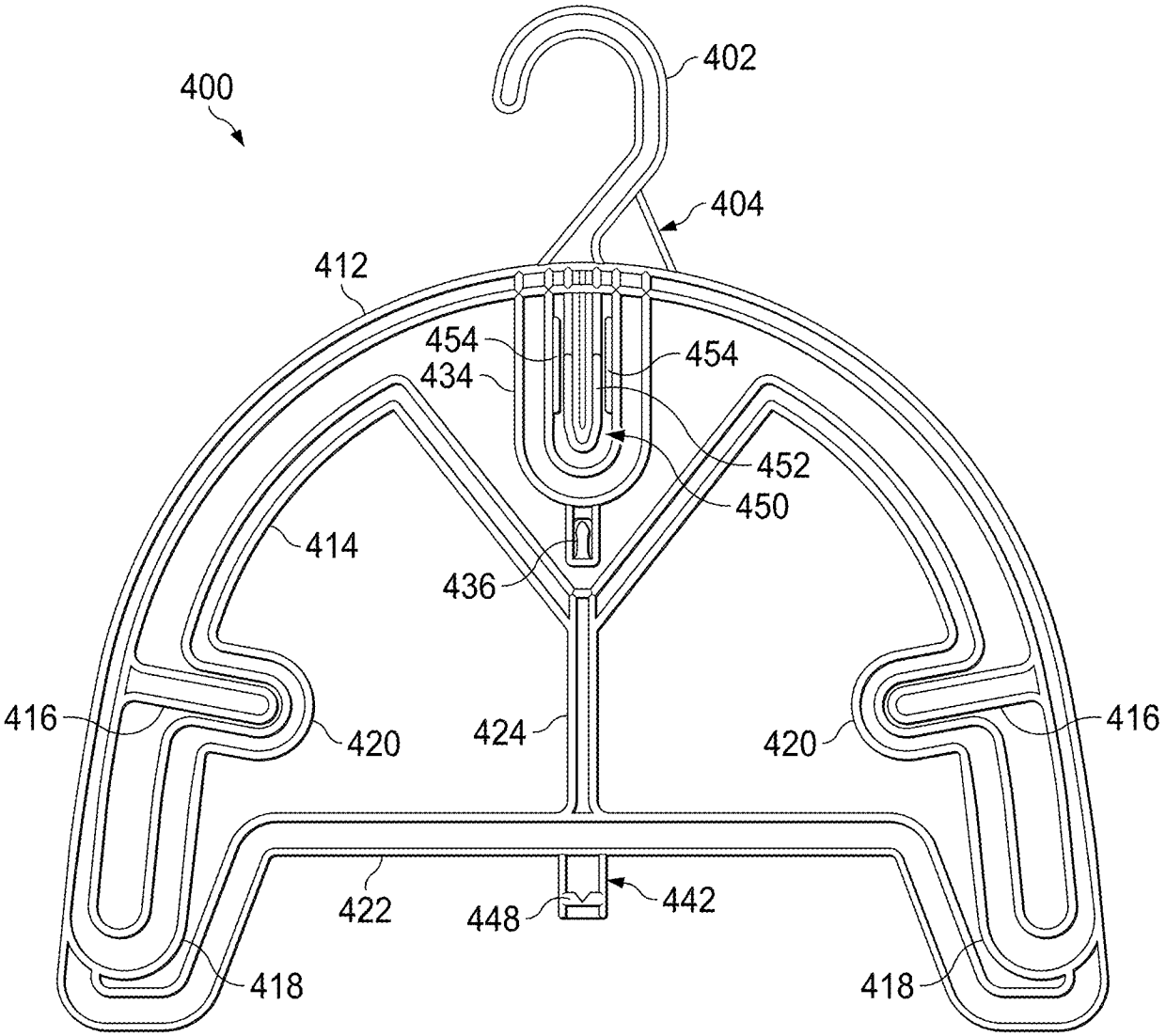
FIG. 4 illustrates a front view of a hanger, in accordance with some embodiments of the disclosure.

FIG. 4 illustrates an example embodiment of a hanger 400 from a front view. The hanger 400 may comprise a hook 402, sizer clip receiver 404, outer frame 412, inner frame 414, side clip inner member 416, frame connecting portion 418, side clip outer member 420, lower frame portion 422, inner frame support 424, top clip outer member 434, second support tab 436, first support connector 442, first support tab catch 448, top clip inner member 450, top clip ramped portion 452, and/or top clip protrusion 454.

As illustrated in FIG. 4, a sizer clip receiver 404 need not comprise the structure associated with the sizer clip of FIGS. 1A-1G. For example, a sizer clip receiver 404 may comprise a support portion and a raised portion at the outside boundary of the sizer clip receiver 404, as illustrated in FIG. 4. The sizer clip receiver 404 of FIG. 4 may or may not be operable to receive and/or retain an attached sizer clip, depending on the design of the sizer clip. For example, a sizer clip compatible with the sizer clip receiver of FIGS. 1A-1G may or may not be compatible with the sizer clip receiver 404 of FIG. 4. Additionally or alternatively, a sizer clip design different than a sizer clip design compatible with the sizer clip receiver of FIGS. 1A-1G may be compatible with the sizer clip receiver 404 of FIG. 4. For example, a sized clip comprising a spring-loaded clip and/or resilient plastic that clasps closed in a resting state may be used to attach to the sizer clip receiver 404.

As illustrated in FIG. 4, one or more top clip ramped portions 452 may be comprised on the front and/or back of the hanger 400 (or neither side). FIG. 4 also illustrates the structure of a first support connector 442 (which may also be used as a second support connector) and a first support tab catch 448 thereof without an inserted first support tab. Additionally, a second support tab 436 (which may also be used as a first support tab) is illustrated without an attached second support connector from a second support. A hanger 400 may be used with or without one or more supports (e.g. a first support and/or a second support) attached. Supports may be integrally formed with the hanger 400 and/or be attached to the hanger via one or more connectors 442, tabs 436, and/or tab catches 448. Alternative connector designs (e.g. male/female connectors, interference fit, adhesive connection, connection via additional hardware such as screws and/or nuts, and/or Velcro) may be used to attached one or more supports to a hanger 400. Supports may be used for other purposes than supporting hung garments. For example, an attached support may comprise pockets and/or compartments for storing small items (e.g. buttons associated with a garment hung by the hanger, and/or pins used to pin at least a portion of the garment).

Figure 5:
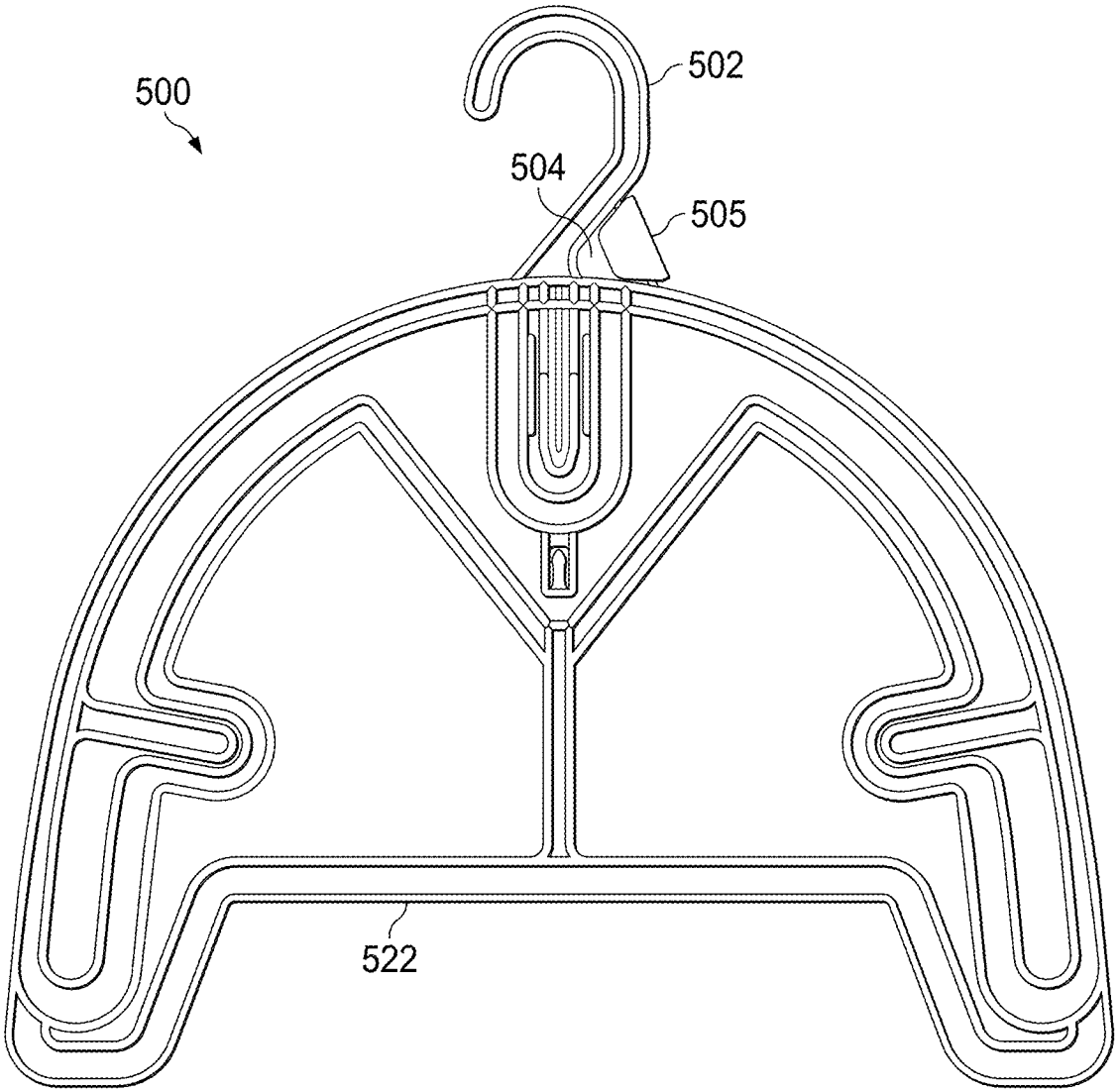
FIG. 5 illustrates a front view of a hanger, in accordance with some embodiments of the disclosure.

FIG. 5 illustrates an example embodiment of a hanger 500 from a front view. The hanger 500 may comprise a hook 502, sizer clip receiver 504, sizer clip 505, and/or lower frame portion 422.

In some embodiments, a hanger 500 may or may not comprise connectors, male portions, female portions, and/or connector receivers for facilitating attachment of one or more supports to the hanger. For example, as illustrated in FIG. 5, a lower frame portion may not comprise a first support connector, a first support tab catch thereof, and/or a first support tab for connecting a first support. For example, a hanger 500 need not hang more than one garment, and/or need not hang garments in addition to headwear clipped and/or supported by a frame of the hanger 500. Also illustrated in FIG. 5, a hanger 500 may comprise and/or receive a sizer clip 505. A sizer clip may extend into a sizer clip receiving portion 504 after installation and/or attachment. A sizer clip may be rigidly attached (e.g. with little mechanical play and/or looseness), and/or a sizer clip may be loosely attached. A sizer clip 505 may comprise a color, material, texture, text label, and/or other indicator associated with one or more garment sizes, garment size ranges, and/or garment types.

Figure 6:
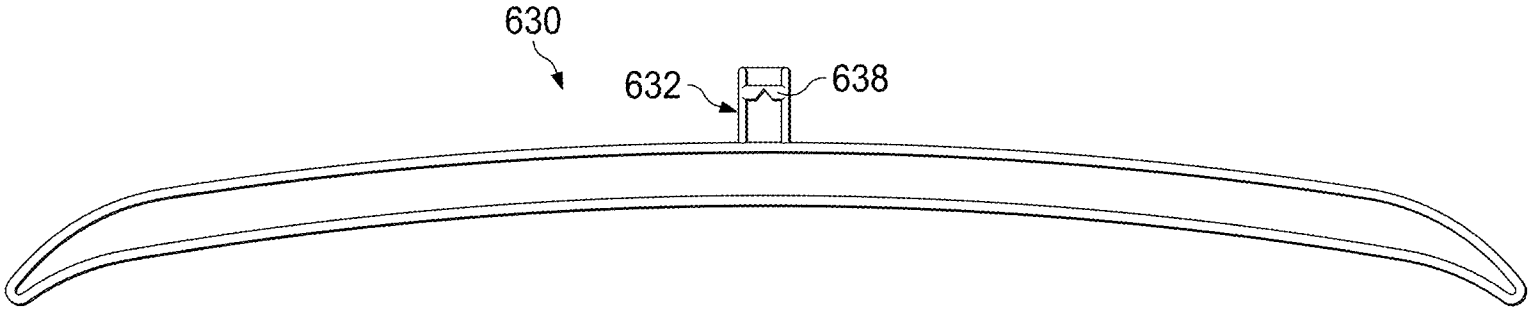
FIG. 6 illustrates a front view of a hanger support, in accordance with some embodiments of the disclosure.
Figure 7:
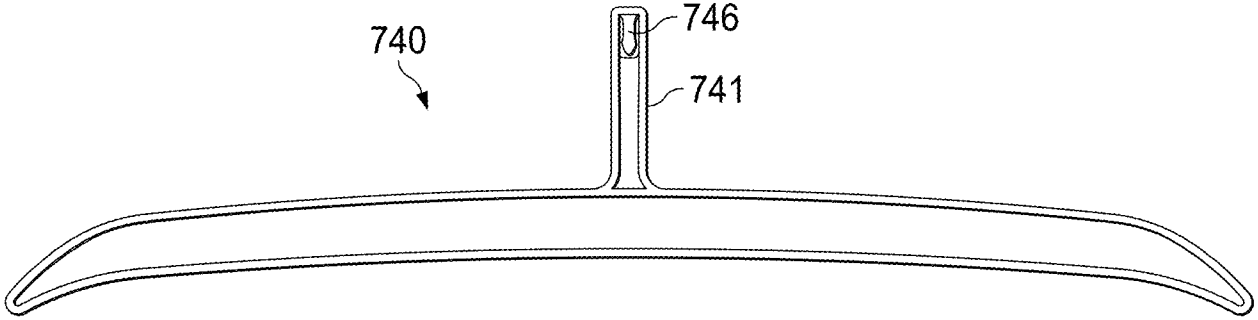
FIG. 7 illustrates a front view of a hanger support, in accordance with some embodiments of the disclosure.

FIG. 6 and FIG. 7 illustrate an example embodiment of a second support 630 and a first support 740, respectively. A second support 630 may comprise a second support connector 632 and/or a second support tab catch 638. A first support 740 may comprise a first support connecting portion 741 and/or a first support tab 746. In some embodiments, a first support 740 may be longer than a second support 630. In some embodiments, a first support 740 may be shorter than a second support 630. In some embodiments, a first support 740 may be substantially the same length as a second support 630. In some embodiments, a first support 740 and/or second support 630 may comprise different connectors than what is illustrated in FIGS. 6 and 7. For example, a second support 630 may comprise a connecting portion and/or a support tab, while a first support 740 may comprise a support connector and/or support tab catch. In some embodiments, a first support 740 and a second support 630 may be identical and/or interchangeable (e.g. with respect to attaching the first support 740 and/or second support 630 to a hanger). In some embodiments, a first support 740 and/or second support 630 may comprise additional structure and/or connectors, such as one or more spring loaded clips (e.g. for hanging shorts and/or legwear), one or more hooks (e.g. for hanging a tank top and/or camisole), and/or one or more notches (e.g. for hanging a lace slip and/or brassiere). A first support 740 and/or second support 630 may comprise one or more additional bars, rods and/or elongated portions, which may be spring-loaded and/or attached to the first support 740 and/or second support 630 on at least one side via a resilient material. The one or more additional bars, rods, and/or elongated portions may be used to clamp and/or secure a hung garment (e.g. legwear) between the one or more additional bars, rods, and/or elongated portions, and the first support 740 and/or second support 630. In some embodiments a first support 740 and/or second support 630 may be referred to as a bar, rod, elongated portion and/or horizontally elongated structure.

Figure 8A:
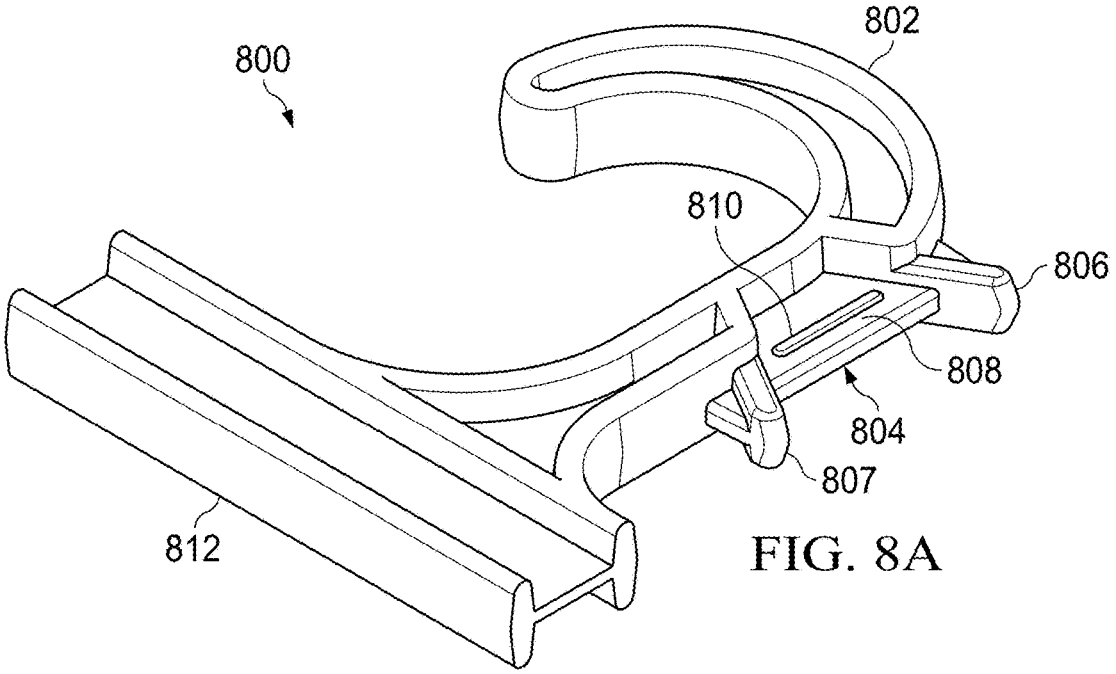
FIG. 8A illustrates a perspective view of a hanger portion, in accordance with some embodiments of the disclosure.

FIG. 8A illustrates an example embodiment of a hanger portion 800 from a perspective view. A hanger portion may comprise a hook 802, sizer clip receiver 804, top guiding portion 806, bottom guiding portion 807, support portion 808, catch protrusion 810, and/or hanger frame portion 812.

As illustrated in FIG. 8A, a sizer clip receiver 804 may be embedded and/or integrally formed within a hook 802. A sizer clip receiver 804 may operate and/or comprise similar structural features to the sizer clip receiver of FIGS. 1A-1G. A sizer clip receiver 804 may comprise a support portion 808 operable to support at least a portion of an attached sizer clip, and/or a catch protrusion 810 operable to prevent and/or inhibit removal (and/or inadvertent detachment) of an installed and/or attached sizer clip (not shown in FIG. 8A). Additionally or alternatively, a sizer clip receiver may comprise a catch depression (not shown in FIG. 8A) to substantially lock in and/or secure an attached sizer clip. For example, a sizer clip may comprise one or more teeth and/or hook portions that are operable to be slightly bent outward during attachment to the sizer clip receiver 804, after which the one or more teeth and/or hook portions may sink into a catch depression, thereby inhibiting the removal of an attached sizer clip. A sizer clip receiver 804 may additionally or alternatively comprise one or more guiding portions 806, 807 operable to guide and/or limit the vertical movement of a sizer clip during installation and/or attachment to a sizer clip receiver 804. Additionally or alternatively, one or more sizer clip guiding portions 806, 807 may reduce vertical mechanical play of an attached sizer clip, and/or may provide structural protection to external forces (e.g. a human hand picking up and/or manipulating the hanger portion 800) that may pressure an attached sizer clip to detach from a sizer clip receiver 804. A sizer clip receiver 804 and/or one or more sizer clip guiding portions 806, 807 may comprise a substantially trapezoidal shape, which may or may not correspond to and/or be complementary to the geometry of a sizer clip.

The hanger portion 800 may be associated with a hanger with headwear clips (e.g. as illustrated and described in FIGS. 1A-1G), and/or any other type of hanger. For example, the hanger portion 800 may correspond to a single horizontally elongated support for supporting a single garment. Additionally or alternatively, the hanger portion may be associated with a support comprising one or more clips (e.g. spring-loaded and/or internally textured clips) for clasping and/or gripping a garment, legwear, fabric, etc.

Figure 8B:
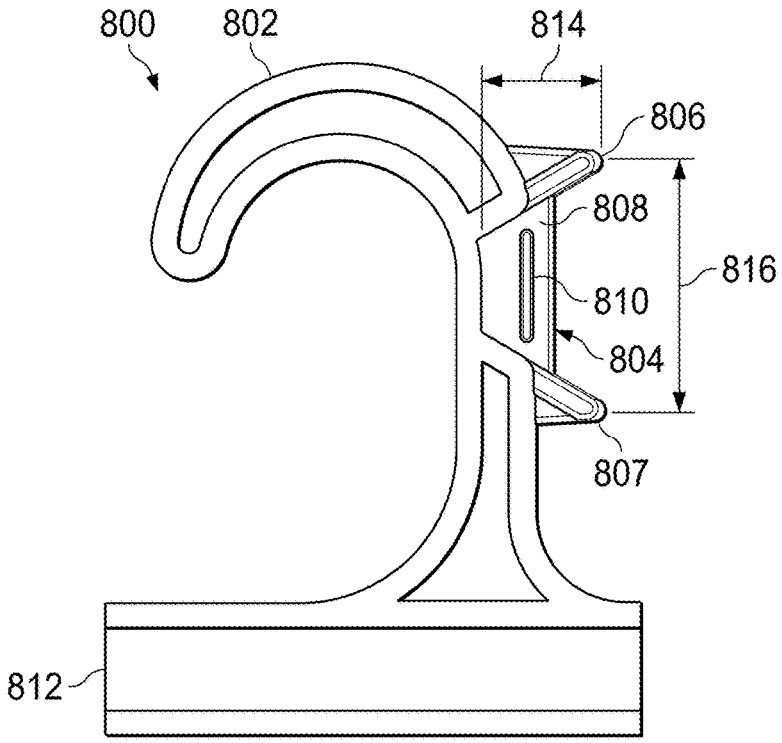
FIG. 8B illustrates a front view of a hanger portion, in accordance with some embodiments of the disclosure.

FIG. 8B illustrates an example embodiment of a hanger portion 800 from a front view. A hanger portion may comprise a hook 802, sizer clip receiver 804, top guiding portion 806, bottom guiding portion 807, support portion 808, catch protrusion 810, hanger frame portion 812, depth dimension 814, and/or height dimension 816.

A depth dimension 814 of a sizer clip receiver 804 may be less than, substantially equal to, and/or greater than an associated depth dimension of a sizer clip. In some embodiments, a depth dimension may be defined from the inner boundary of the support portion 808 to the outer edge of one or more guiding portions 807, 808. In some embodiments, a depth dimension may be 0.5 cm-5.0 cm. A height dimension 816 of a sizer clip receiver 804 may be less than, substantially equal to, and/or greater than an associated height dimension of a sizer clip. In some embodiments, a height dimension may be defined from the outer edge of the top guiding portion 806 to the outer edge of the bottom guiding portion 808. In some embodiments, a height dimension may be 1.0 cm-8.0 cm. In some embodiments, a depth and/or height of a sizer clip may extend beyond and/or over the hook 802 and/or one or more guiding portions 806, 807.

Figure 8C:
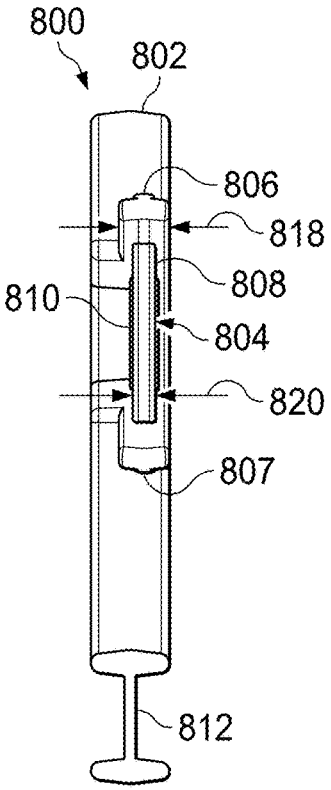
FIG. 8C illustrates a right view of a hanger portion, in accordance with some embodiments of the disclosure.

FIG. 8C illustrates an example embodiment of a hanger portion 800 from a right view. A hanger portion may comprise a hook 802, sizer clip receiver 804, top guiding portion 806, bottom guiding portion 807, support portion 808, catch protrusion 810, hanger frame portion 812, outer width dimension 818, and/or inner width dimensions 820.

An outer width dimension 818 of a sizer clip receiver 804 may be less than, substantially equal to, and/or greater than an associated outer width dimension of a sizer clip. In some embodiments, an outer width dimension may be defined from a front face of one or more guiding portions 807, 808 to a back face of one or more guiding portions 807, 808. In some embodiments, an outer width dimension may be 0.2 cm-3.0 cm. An inner width dimension 820 of a sizer clip receiver 804 may be less than, substantially equal to, and/or greater than an associated height dimension of a sizer clip. In some embodiments, an inner width dimension may be defined from a front face of a support portion 808 to a back face of a support portion 808. In some embodiments, an inner width dimension may be 0.1 cm-2.0 cm. In some embodiments, an outer width and/or inner width of a sizer clip may extend beyond and/or over a width of a hook 802 and/or a width one or more guiding portions 806, 807.

Figure 9A:
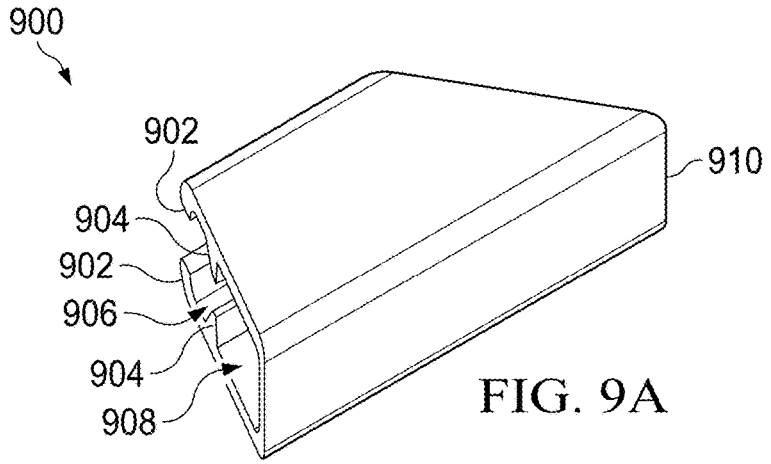
FIG. 9A illustrates a perspective view of a sizer clip, in accordance with some embodiments of the disclosure.

FIG. 9A illustrates an example embodiment of a sizer clip 900 from a perspective view. A sizer clip 900 may comprise one or more first protrusions 902, one or more second protrusions 904, a first cavity 906, a second cavity 908, and/or a side portion 910.

A sizer clip 900 (which in some embodiments may be referred to as a hanger marker) may comprise a first cavity 906 formed by one or more first protrusions 902 and one or more second protrusions 904. Additionally or alternatively, a sizer clip 900 may comprise a second cavity 908 formed by one or more second protrusions 904 and a side portion 910 (and/or the inner wall thereof). A sizer clip may be configured to be disposed on a sizer clip receiver (not shown in FIG. 9A) and/or a catch protrusion thereof. For example, one or more first protrusions 902 of a sizer clip may be pushed, forced, and/or bent over a catch protrusion of a sizer clip receiver such that the catch protrusion sits in the first cavity 906. Additionally or alternatively, one or more second protrusions 904 of a sizer clip may be pushed, forced, and/or bent over a catch protrusion of a sizer clip receiver such that the catch protrusion sits in the second cavity 908. In order to be attached to, installed on, and/or inserted over a sizer clip receiver, a sizer clip 900 and/or at least a portion thereof (e.g. one or more first protrusions 902, one or more second protrusions 904, and/or a side portion 910) may comprise a flexible, bendable, malleable, resilient, and/or pliable material and/or structure (e.g. rubber, plastic, spring loaded assembly).

A sizer clip 900 may be used and/or attached to a hanger (not shown in FIG. 9A) in order to facilitate identification of the hanger size, hanger type, hanger owner, associated garment size, gender of an associated garment, and/or associated garment type. A sizer clip may comprise one or more colors, materials, depressions, markings (e.g. on a front, side, and/or back of the sizer clip 900), labels, shapes, and/or material properties to associate the sizer clip with a particular hanger and/or garment type.

Figure 9B:
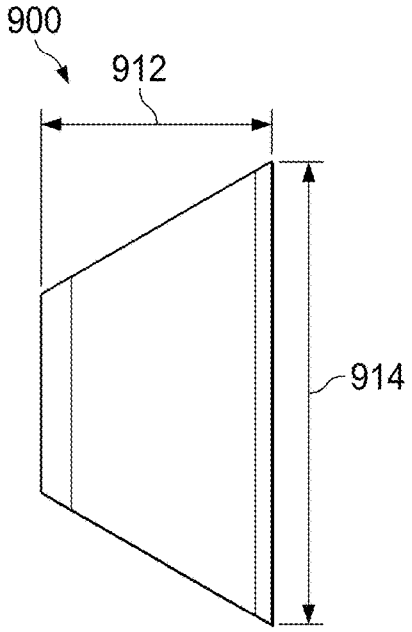
FIG. 9B illustrates a front view of a sizer clip, in accordance with some embodiments of the disclosure.

FIG. 9B illustrates an example embodiment of a sizer clip 900 from a front view. A sizer clip 900 may comprise a depth dimension 912 and/or a height dimension 914.

A depth dimension 912 of a sizer clip 900 may be greater than, substantially equal to, and/or less than a depth dimension of an associated sizer clip receiver. A depth dimension 912 may be defined from an outer edge of one or more first protrusions 902 to the outer edge of a side portion 910. In some embodiments, a depth dimension 912 may be 1.0 cm to 5.0 cm. A height dimension 914 of a sizer clip 900 may be greater than, substantially equal to, and/or less than a height dimension of an associated sizer clip receiver. A height dimension 914 may be defined from a top edge of a side portion 910 to a bottom edge of a side portion 910. In some embodiments, a depth dimension 914 may be 1.0 cm to 8.0 cm.

Figure 9C:
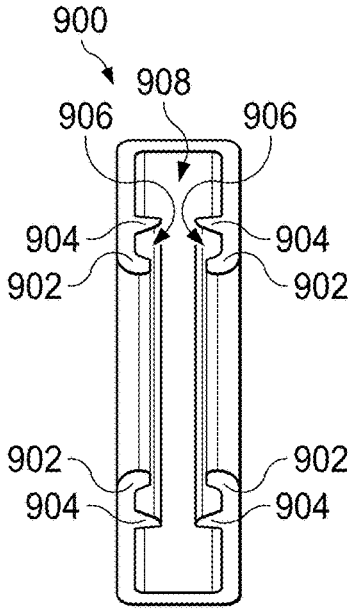
FIG. 9C illustrates a left view of a sizer clip, in accordance with some embodiments of the disclosure.

FIG. 9C illustrates an example embodiment of a sizer clip 900 from a left view. A sizer clip 900 may comprise one or more first protrusions 902, one or more second protrusions 904, a first cavity 906, and/or a second cavity 908. In some embodiments, the inner side of a sizer clip 900 (e.g. the side corresponding to the one or more first protrusions 902) may be shorter, substantially the same height as, and/or longer than the outer side of a sizer clip 900 (e.g. the side corresponding to the side portion). In some embodiments, a sizer clip 900 may comprise a trapezoidal, rounded trapezoidal, triangular, rounded triangular, rectangular, rounded rectangular, disc-like, circular, cylindrical, and/or spherical geometry.

Figure 9D:
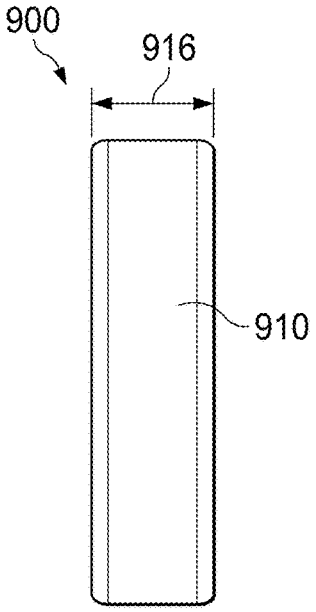
FIG. 9D illustrates a right view of a sizer clip, in accordance with some embodiments of the disclosure.

FIG. 9D illustrates an example embodiment of a sizer clip 900 from a right view. A sizer clip 900 may comprise a side portion 910 and/or a width dimension 916.

A width dimension 916 of a sizer clip 900 may be greater than, substantially equal to, and/or less than an outer width dimension of an associated sizer clip receiver. A width dimension 916 may be defined from a front face of a side portion 910 to a back face of a side portion 910. In some embodiments, a width dimension 916 may be 0.2 cm to 3.0 cm.

Figure 9E:
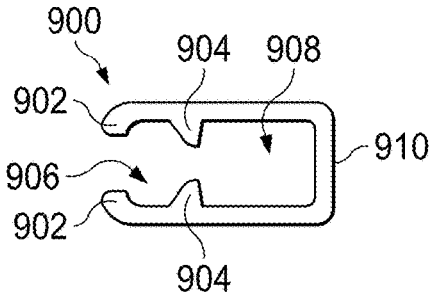
FIG. 9E illustrates a top view of a sizer clip, in accordance with some embodiments of the disclosure.

FIG. 9E illustrates an example embodiment of a sizer clip 900 from a top and/or bottom view. A sizer clip 900 may comprise one or more first protrusions 902, one or more second protrusions 904, a first cavity 906, a second cavity 908, and/or a side portion 910.

In some embodiments, one or more first protrusions 902 may be shallower and/or not penetrate as deeply into an interior region of the sizer clip 900 as the one or more second protrusions 904. For example, such an arrangement may facilitate insertion of a sizer clip 900 over a catch protrusion of a sizer clip receiver (not shown in FIG. 9E), as the material and/or resilient properties of the sizer clip 900 may allow for an inner side and/or one or more first protrusions 902 of a sizer clip to be bent and/or deflected of over the catch protrusion, while rendering it more difficult to bend and/or deflect one or more second protrusions 904 over the catch protrusion. In this way, the catch protrusion may be disposed within the first cavity 906 of the sizer clip 900. Additionally or alternatively, the one or more second protrusions, may be bent and/or deflected over a catch protrusion of a sizer clip receiver, which may result in the catch protrusion of the sizer clip receiver being disposed in the second cavity 908 of the sizer clip 900. A near side of the one or more first protrusions 902 and/or the one or more second protrusions 904 may be ramped and/or gradually thickened from an inner side of the sizer clip 900 to an outer side of the sizer clip 900, which may facilitate pushing the sizer clip 900 over a catch protrusion of a sizer clip receiver. Additionally or alternatively, a far side of the one or more first protrusions 902 and/or the one or more second protrusions 904 may have a relatively steeper drop-off and/or decrease in depth, which may make it more difficult to remove a sizer clip 900 from a sizer clip receiver than to attach the sizer clip 900 to a sizer clip receiver.

In some embodiments, a hanger, sizer clip, and/or portions thereof may be integrally formed (e.g. by injection molding, 3D printing, subtractive manufacturing, and/or die casting). Additionally or alternatively, portions and/or elements of a hanger may be attached to other portions and/or elements of a hanger via adhesive, interference fit, male and female connectors, clips, clamping components, snap fits, attachment hardware (e.g. nail, screws, rivets, washers, nuts, and/or bolts), welding, material fusion, one or more latches, one or more fasteners, and/or gravity. Any portion and/or element of a hanger and/or sizer clip described herein may be connected to, attached to, and/or integrally formed with any other portion and/or element of a hanger and/or sizer clip described herein.

Hangers, sizer clips, and/or any portions thereof may be comprised of one or more of plastic, colored plastic, clear plastic, tubular plastic, thermoplastic, thermoset, polymer, metal, steel, aluminum, alloy, wire, chrome hardware, brass hardware, wood (e.g. teak, maple, oak, mahogany, artificial wood), cloth (e.g. cotton, satin), padding, vinyl coating, rubber, rubber coating, flexible materials, rigid materials, textured materials, ridged materials, etc.

A hanger may be used to display, transport, prevent wrinkles of, facilitate drying of, vertically extend, and/or flatten one or more hung and/or supported garments. A hanger may be assembled by snapping together components, depressing one or more depressible tabs, creating an interference fit between one or more components, screwing together one or more components and/or bending one or more components.

A clip (e.g. top clip, side clip, headwear clip, garment clip, and/or legwear clip) may comprise one or more tongues (e.g. clip inner member), one or more clip supporting and/or background portions (e.g. clip outer member), one or more spring loaded clamps, and/or one or more ramped portions. Additionally or alternatively, a clip and/or one or more of the clamp portions thereof may comprise a rubber coating, a textured interior, a vinyl coating, and/or pull and/or push tab to facilitate human manipulation of the clip.

In some embodiments, headwear clipped to and/or attached to a hanger may comprise a hood, pajama hood, costume hood, costume head piece, beanie cap, decorative hat, seasonal hat, baseball cap, and/or any other kind of headwear and/or headgear. In some embodiments, a hanger (and/or clips and/or supports thereof) may be used to hang and/or support a suit, jacket, costume, dress, shirt, dress shirt, pants, jeans, socks, underwear, shoes, scarves, gloves, masks, earrings, and/or jewelry.

In some embodiments, one or more top clips and/or side clips may project outwardly from a center region of the hanger frame (e.g. from an inner frame) instead of inwardly to a center region of the hanger frame (e.g. from an outer frame). In some embodiments, a hanger frame and/or one or more supports thereof may comprise a width of approximately 6" to 20" (e.g. a hanger frame may have a width of 8", a first support may have a width of 12", and/or a second support may have a width of 14").

Apparel, garments, fabric, clothing, and/or accessories may be hung by opening one or more clips prior to insertion of the apparel, garment, fabric, clothing, and/or accessories, and then releasing the one or more clips after insertion (e.g. a pair of pants may be clipped by clips of a second support). Additionally or alternatively apparel, garment, fabric, clothing, and/or accessories may be draped over and/or hung on one or more supports (e.g. one or more supports may be inserted through the neck hole of a shirt, and/or one or more supports may be used to hang a pair of folded pants). The ability to attach and/or connect and detach and/or disconnect one or more supports from a hanger and/or frame thereof may facilitate mixing garments hung on a single hanger, isolating one or more garments of a hanger from one or more other garments of a hanger, hanging one or more garments from a hanger (e.g. it may be advantageous to remove a first support from a hanger, insert the first support into a hooded jacket, attach the first support to the hanger, and then clip the hood of the hooded jacket to the hanger frame), manufacturing the hanger, assembling the hanger, and/or transporting the hanger.

While various implementations in accordance with the disclosed principles have been described above, it should be understood that they have been presented by way of example only, and are not limiting. Thus, the breadth and scope of the implementations should not be limited by any of the above-described exemplary implementations, but should be defined only in accordance with the claims and their equivalents issuing from this disclosure. Furthermore, the above advantages and features are provided in described implementations, but shall not limit the application of such issued claims to processes and structures accomplishing any or all of the above advantages. Any component of any system may be combined with any component of any other system (and/or the same system). Any step of any method and/or process may be combined with any other step (or a same step) of any other (or same) method and/or process. Any system operable to realize a described method or process could be used. A described system could be configured to carry out any method, step, and/or procedure which the system is operable to carry out.

Various terms used herein have special meanings within the present technical field. Whether a particular term should be construed as such a "term of art," depends on the context in which that term is used. "Connected to" or other similar terms should generally be construed broadly to include situations where connections are direct between referenced elements or through one or more intermediaries between the referenced elements. These and other terms are to be construed in light of the context in which they are used in the present disclosure and as those terms would be understood by one of ordinary skill in the art would understand those terms in the disclosed context. The above definitions are not exclusive of other meanings that might be imparted to those terms based on the disclosed context.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, any section headings provided herein are for consistency with the suggestions under 37 C.F.R. 1.77 or otherwise to provide organizational cues. These headings shall not limit or characterize the implementations set out in any claims that may issue from this disclosure. Specifically and by way of example, although the headings may refer to a "Technical Field," such claims should not be limited by the language chosen under this heading to describe the so-called technical field. Further, a description of a technology in the "Background" is not to be construed as an admission that technology is prior art to any implementations in this disclosure. Neither is the "Summary" to be considered as a characterization of the implementations set forth in issued claims. Furthermore, any reference in this disclosure to "implementation" in the singular should not be used to argue that there is only a single point of novelty in this disclosure. Multiple implementations may be set forth according to the limitations of the multiple claims issuing from this disclosure, and such claims accordingly define the implementations, and their equivalents, that are protected thereby. In all instances, the scope of such claims shall be considered on their own merits in light of this disclosure, but should not be constrained by the headings herein.

Additionally, although similar reference numbers may be used to refer to similar elements for convenience, it can be appreciated that each of the various example implementations may be considered distinct variations.

Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, apparatuses, and/or methods may exclude any other features or steps beyond those disclosed herein. Elements, devices, methods, and method steps not recited may be included or excluded as desired or required. Persons skilled in the art may make various changes in methods of preparing and using a device and/or system of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/−about 10%, depicted value+/−about 50%, depicted value+/−about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

It will be understood that particular embodiments described herein are shown by way of illustration and not as limitations of the disclosure. The principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

The title, abstract, background, and headings are provided in compliance with regulations and/or for the convenience of the reader. They include no admissions as to the scope and content of prior art and no limitations applicable to all disclosed embodiments.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

All of the compositions and/or methods disclosed and claimed herein can be made and executed without undue experimentation in light of the present disclosure. While the compositions and methods of this disclosure include preferred embodiments, it will be apparent to those of skill in the art that variations may be applied to the compositions and/or methods and in the steps or in the sequence of steps of the method described herein without departing from the concept, spirit and scope of the disclosure. All such similar substitutes and modifications apparent to those skilled in the art are deemed to be within the spirit, scope and concept of the disclosure as defined by the appended claims.

What is claimed is:

1. A hanger comprising:

a hook configured to hang the hanger;

an outer frame extending outward from the bottom portion of the hook, the outer frame comprising a first side clip inner member and a second side clip inner member;

an inner frame connected to the outer frame at a first bottom portion and a second bottom portion of the outer frame, the inner frame comprising a first side clip outer member and a second side clip outer member;

a first support connecting portion extending downward from a middle bottom portion of the inner frame; and a first support connected to the first support connecting portion, the first support comprising a substantially horizontally elongated shape.

2. The hanger of claim 1, wherein at least one of the top clip inner member, the first side clip inner member, and the second side clip inner member comprises a ramped portion.

3. The hanger of claim 1, wherein the first support comprises a first support connector configured to receive a first support tab comprised in the middle bottom portion of the inner frame.

4. The hanger of claim 1, further comprising a second support connected to a bottom portion of the top clip outer member.

5. The hanger of claim 4, wherein the second support comprises a second support tab configured to be inserted into a second support connector comprised in the bottom portion of the top clip outer member.

6. The hanger of claim 1, further comprising a sizer web receiving portion disposed between the hook and the frame.

7. The hanger of claim 6, wherein the sizer web receiving portion comprises a catch protrusion.

8. The hanger of claim 6, wherein the sizer web receiving portion comprises at least one guiding portion.

9. The hanger of claim 6, further comprising a sizer web connected to the sizer web receiving portion.

10. The hanger of claim 9, wherein the sizer web comprises two first protrusions and two second protrusions, wherein the two first protrusions and the two second protrusions form a first cavity, and wherein the catch protrusion is disposed within the first cavity.

* * * * *